US008393938B2

(12) United States Patent
Sung

(10) Patent No.: US 8,393,938 B2
(45) Date of Patent: Mar. 12, 2013

(54) CMP PAD DRESSERS

(76) Inventor: Chien-Min Sung, Tansui (TW)

( * ) Notice: Subject to any disclaimer, the term of this patent is extended or adjusted under 35 U.S.C. 154(b) by 896 days.

(21) Appl. No.: 12/267,172

(22) Filed: Nov. 7, 2008

(65) Prior Publication Data

US 2009/0123705 A1 May 14, 2009

Related U.S. Application Data

(60) Provisional application No. 60/987,687, filed on Nov. 13, 2007, provisional application No. 60/988,643, filed on Nov. 16, 2007.

(51) Int. Cl.
*B24B 55/00* (2006.01)

(52) U.S. Cl. ..... 451/443

(58) Field of Classification Search ..... 451/443, 451/444

See application file for complete search history.

(56) References Cited

U.S. PATENT DOCUMENTS

| | | | |
|---|---|---|---|
| 1,854,071 | A | 4/1932 | Schacht |
| 2,027,087 | A | 1/1936 | Buckner |
| 2,027,307 | A | 1/1936 | Schacht |
| 2,033,991 | A | 3/1936 | Melton |
| 2,035,521 | A | 3/1936 | Benner |
| RE20,660 | E | 2/1938 | Schacht |
| 2,184,348 | A | 12/1939 | Kirchner |
| 2,187,624 | A | 1/1940 | Melton |
| 2,194,253 | A | 3/1940 | Benner |
| 2,281,558 | A | 5/1942 | Cross |
| 2,318,570 | A | 5/1943 | Carlton |
| 2,334,572 | A | 11/1943 | Melton |
| 3,377,411 | A | 4/1968 | Charvat |
| 3,440,774 | A | 4/1969 | Curn |
| 3,608,134 | A | 9/1971 | Cook |
| 3,625,666 | A | 12/1971 | James |
| 3,631,638 | A | 1/1972 | Yoshikawa et al. |
| 3,743,489 | A | 7/1973 | Wentorf et al. |
| 3,767,371 | A | 10/1973 | Wentorf et al. |
| 3,819,814 | A | 6/1974 | Pope |
| 3,852,078 | A | 12/1974 | Wakatsuki |
| 4,078,906 | A | 3/1978 | Green |
| 4,188,194 | A | 2/1980 | Corrigan |
| 4,224,380 | A | 9/1980 | Bovenkerk et al. |
| 4,289,503 | A | 9/1981 | Corrigan |
| 4,390,647 | A | 6/1983 | Girgis |
| 4,481,016 | A | 11/1984 | Campbell et al. |

(Continued)

FOREIGN PATENT DOCUMENTS

| | | |
|---|---|---|
| CN | 1494984 | 5/2004 |
| EP | 1 075 898 | 2/2001 |

(Continued)

OTHER PUBLICATIONS

U.S. Appl. No. 11/940,935, filed Nov. 15, 2007, Chien-Min Sung. Office action issued Feb. 19, 2010.

(Continued)

*Primary Examiner* — Maurina Rachuba

(74) *Attorney, Agent, or Firm* — Thorpe North & Western LLP

(57) ABSTRACT

An abrasive tool includes an assembly of tool precursors. At least one of the tool precursors has a continuous polycrystalline diamond, polycrystalline cubic boron nitride, or ceramic material cutting element formed into a blade shape. The abrasive tool can additionally include a setting material, which is configured to attach the tool precursors and form a single mass. The selection, arrangement, and setting of the tool precursors can result in an abrasive tool having a predetermined cutting configuration. Methods for forming such an abrasive tool are also disclosed.

9 Claims, 11 Drawing Sheets

U.S. PATENT DOCUMENTS 4,525,179 A 6/1985 Gigi
4,629,373 A 12/1986 Hall
4,662,896 A 5/1987 Dennis
4,776,861 A 10/1988 Frushour
4,795,678 A 1/1989 Girgis
4,797,241 A 1/1989 Peterson et al.
4,828,582 A 5/1989 Frushour
4,849,602 A 7/1989 Gardner
4,923,490 A 5/1990 Johnson et al.
4,925,457 A 5/1990 deKok et al.
4,954,139 A 9/1990 Cerutti
5,011,513 A 4/1991 Zador et al.
5,037,451 A 8/1991 Burnand et al.
5,038,555 A 8/1991 Wu et al.
5,043,120 A 8/1991 Corrigan
5,049,165 A 9/1991 Tselesin
5,137,543 A 8/1992 Heath et al.
5,151,107 A 9/1992 Cho et al.
5,190,568 A 3/1993 Tselesin
5,194,071 A 3/1993 Corrigan
5,195,403 A 3/1993 Sani et al.
5,195,404 A 3/1993 Notter et al.
5,232,320 A 8/1993 Tank et al.
5,243,790 A 9/1993 Gagne
5,247,765 A 9/1993 Quintana
5,314,513 A 5/1994 Miller
5,364,423 A 11/1994 Bigelow et al.
5,374,293 A 12/1994 Takashita et al.
5,380,390 A 1/1995 Tselesin
5,453,106 A 9/1995 Roberts
5,486,131 A 1/1996 Cesna et al.
5,505,272 A * 4/1996 Clark ..... 175/405.1
5,527,424 A 6/1996 Mullins
5,536,202 A * 7/1996 Appel et al. ..... 451/285
5,547,417 A 8/1996 Breivogel et al.
5,560,745 A 10/1996 Roberts
5,560,754 A 10/1996 Johnson et al.
5,851,138 A 12/1998 Hempel
5,921,856 A 7/1999 Zimmer
5,924,917 A 7/1999 Benedict et al.
5,975,988 A 11/1999 Christianson
5,985,228 A 11/1999 Corrigan et al.
6,001,008 A * 12/1999 Fujimori et al. ..... 451/443
6,024,824 A 2/2000 Krech
6,027,659 A 2/2000 Billet
6,039,641 A 3/2000 Sung
6,054,183 A 4/2000 Zimmer et al.
6,093,280 A 7/2000 Kirchner et al.
6,159,087 A 12/2000 Birang et al.
6,179,886 B1 1/2001 Gordeev et al.
6,190,240 B1 2/2001 Kinoshita et al.
6,196,911 B1 3/2001 Preston et al.
6,206,942 B1 3/2001 Wood
6,213,856 B1 4/2001 Cho et al.
6,217,413 B1 4/2001 Christianson
6,224,469 B1 * 5/2001 Ohmori et al. ..... 451/56
6,258,138 B1 7/2001 DeVoe et al.
6,258,201 B1 7/2001 Krech
6,258,237 B1 7/2001 Gal-Or et al.
6,281,129 B1 8/2001 Easter et al.
6,605,798 B1 8/2001 Wang et al.
6,284,556 B1 9/2001 Wang et al.
6,293,854 B1 9/2001 Kimura et al.
6,299,508 B1 10/2001 Gagliardi et al.
6,319,108 B1 11/2001 Adefris et al.
6,346,202 B1 2/2002 Molnar
6,354,918 B1 3/2002 Togawa et al.
6,368,198 B1 4/2002 Sung et al.
6,371,838 B1 4/2002 Holzapfel
6,371,842 B1 4/2002 Romero
6,380,390 B1 4/2002 Reichle et al.
6,439,986 B1 * 8/2002 Myoung et al. ..... 451/443
6,446,740 B2 9/2002 Eyre
6,478,831 B2 11/2002 Tselesin
6,616,725 B2 9/2003 Cho et al.
6,626,167 B2 9/2003 Kim et al.
6,672,943 B2 1/2004 Vogtmann et al.
6,694,847 B2 2/2004 Hiroyasu et al.
6,749,485 B1 6/2004 James et al.
6,755,720 B1 6/2004 Ishizaki et al.
6,769,969 B1 8/2004 Duescher
6,790,126 B2 9/2004 Wood et al.
6,818,029 B2 11/2004 Myoung et al.
6,824,455 B2 11/2004 Osterheld et al.
6,884,155 B2 4/2005 Sung et al.
6,899,592 B1 5/2005 Kojima et al.
6,905,571 B2 6/2005 Sakuma
6,945,857 B1 9/2005 Doan et al.
7,021,995 B2 4/2006 Toge et al.
7,033,408 B2 4/2006 Fries et al.
7,044,990 B2 5/2006 Ishizaki et al.
7,066,795 B2 6/2006 Balagani et al.
7,150,677 B2 12/2006 Yamashita et al.
7,201,645 B2 4/2007 Sung
7,258,708 B2 8/2007 Sung
7,261,621 B2 * 8/2007 Moon et al. ..... 451/287
7,384,436 B2 6/2008 Sung
7,465,217 B2 12/2008 Kinoshita et al.
7,651,386 B2 1/2010 Sung
7,658,666 B2 * 2/2010 Sung ..... 451/56
7,690,971 B2 4/2010 Sung
2001/0009844 A1 7/2001 Cho et al.
2002/0042200 A1 4/2002 Fawcett
2002/0127962 A1 9/2002 Cho et al.
2002/0164928 A1 * 11/2002 Tolles ..... 451/41
2002/0173234 A1 11/2002 Sung et al.
2003/0054746 A1 3/2003 Nussbaumer et al.
2003/0084894 A1 5/2003 Sung
2003/0092357 A1 5/2003 Yoon et al.
2003/0114094 A1 * 6/2003 Myoung et al. ..... 451/443
2003/0207659 A1 11/2003 Annen et al.
2004/0009742 A1 1/2004 Lin et al.
2004/0060243 A1 4/2004 Fries et al.
2004/0079033 A1 4/2004 Long
2004/0107648 A1 6/2004 Sung
2004/0180617 A1 9/2004 Goers
2004/0203325 A1 * 10/2004 Donohue ..... 451/56
2005/0032462 A1 2/2005 Gagliardi et al.
2005/0060941 A1 3/2005 Provow et al.
2005/0118939 A1 6/2005 Duescher
2005/0227590 A1 10/2005 Sung
2005/0260939 A1 11/2005 Andrews et al.
2006/0073774 A1 4/2006 Sung
2006/0079160 A1 * 4/2006 Balagani et al. ..... 451/285
2006/0079162 A1 4/2006 Yamashita
2006/0135050 A1 6/2006 Petersen et al.
2006/0143991 A1 7/2006 Sung
2006/0254154 A1 11/2006 Huang et al.
2006/0258276 A1 11/2006 Sung
2007/0051355 A1 3/2007 Sung
2007/0060026 A1 3/2007 Sung
2007/0066194 A1 3/2007 Wielonski et al.
2007/0093181 A1 4/2007 Lugg et al.
2007/0155298 A1 7/2007 Sung
2007/0249270 A1 10/2007 Sung
2007/0264918 A1 11/2007 Sung
2008/0076338 A1 3/2008 Andrews et al.
2008/0096479 A1 4/2008 Sung
2008/0153398 A1 * 6/2008 Sung ..... 451/56
2008/0171503 A1 7/2008 Sung
2008/0292869 A1 11/2008 Sung
2010/0015898 A1 1/2010 An et al.
2010/0139174 A1 6/2010 Sung
2010/0203811 A1 8/2010 Philipossian et al.
2010/0221990 A1 9/2010 Sung

FOREIGN PATENT DOCUMENTS

EP 1075898 2/2001
EP 1075898 A2 * 2/2001
GB 2239011 6/1991
JP 2003-071718 3/2003
JP 2004/025401 1/2004
KR 20-0339181 1/2004
WO WO 02/31078 4/2002
WO WO 2004/094106 11/2004
WO WO 2006/039413 4/2006

| | | |
|---|---|---|
| WO | WO 2006/124792 | 11/2006 |
| WO | WO 2007/032946 | 3/2007 |
| WO | WO 2008/063599 | 5/2008 |

OTHER PUBLICATIONS

PCT Application PCT/US2007/024165; Nov. 16, 2007; Chien-Min Sung; International Search Report mailed May 23, 2011.
Sung, U.S. Appl. No. 11/512,755, office action issued Oct. 13, 2009.
Sung, U.S. Appl. No. 11/940,935, office action issued Oct. 28, 2009.
Syndite, elementsix advancing diamond, 2 pages. www.e6.com.
U.S. Appl. No. 11/940,935, filed Nov. 15, 2007, Chien-Min Sung. Office Action issued Mar. 23, 2009.
U.S. Appl. No. 12/328,338, filed Dec. 4, 2008, Chien-Min Sung, Office Action issued Jan. 3, 2011.
U.S. Appl. No. 11/805,549, filed May 22, 2007, Chien-Min Sung, Office Action issued Oct. 6, 2010.
U.S. Appl. No. 13/021,350, filed Feb. 4, 2011, Chien-Min Sung; office action issued Aug. 31, 2011.
U.S. Appl. No. 12/328,338, filed Dec. 4, 2008, Chien-Min Sung; office action issued May 10, 2011.
U.S. Appl. No. 12/255,823, filed Oct. 22, 2005; Chien-Min Sung; office action issued Mar. 7, 2012.
U.S. Appl. No. 12/168,110, filed Jul. 5, 2008; Chien-Min Sung; office action issued May 14, 2012.
U.S. Appl. No. 12/715,583; filed Mar. 2, 2010; Chien-Min Sung; office action issued Mar. 21, 2012.
U.S. Appl. No. 13/021,350, filed Feb. 4, 2011; Chien-Min Sung; office action issued Feb. 7, 2012.
U.S. Appl. No. 12/715,583, filed Mar. 2, 2010; Chien-Min Sung, office action issued Oct. 25, 2011.
U.S. Appl. No. 12/715,583, filed Mar. 2, 2010; Chien-Min Sung; notice of allowance dated Dec. 7, 2012.
U.S. Appl. No. 12/715,583, filed Mar. 2, 2010; Chien-Min Sung; office action dated Aug. 9, 2012.
U.S. Appl. No. 13/021,350, filed Feb. 4, 2011; Chien-Min Sung; office action dated Aug. 10, 2012.
U.S. Appl. No. 12/255,823, filed Oct. 22, 2008; Chien-Min Sung; notice of allowance dated Sep. 21, 2012.
U.S. Appl. No. 12/168,110, filed Jul. 5, 2008; Chien-Min Sung; notice of allowance dated Sep. 28, 2012.
U.S. Appl. No. 12/255,823, filed Oct. 22, 2008; Chien-Min Sung; notice of allowance dated Dec. 26, 2012.
U.S. Appl. No. 12/168,110, filed Jul. 5, 2008; Chien-Min Sung; notice of allowance dated Jan. 18, 2013.

* cited by examiner

CMP PAD DRESSERS

PRIORITY CLAIM

This application claims the benefit of: U.S. Provisional Patent Application Ser. No. 60/987,687, filed Nov. 13, 2007; and U.S. Provisional Patent Application Ser. No. 60/988,643, filed Nov. 16, 2007, each of which is hereby incorporated herein by reference.

FIELD OF THE INVENTION

The present invention relates generally to devices and methods for use in connection with dressing or conditioning a chemical mechanical polishing (CMP) pad. Accordingly, the present invention involves the fields of chemical engineering, chemistry, metallurgy, and materials science.

BACKGROUND OF THE INVENTION

Chemical mechanical process (CMP) has become a widely used technique for polishing certain work pieces. Particularly, the computer manufacturing industry has begun to rely heavily on CMP processes for polishing wafers of ceramics, silicon, glass, quartz, metals, and mixtures thereof for use in semiconductor fabrication. Such polishing processes generally entail applying the wafer against a rotating pad made from a durable organic substance such as polyurethane. To the pad is added a chemical slurry containing a chemical solution capable of breaking down the wafer substance and an amount of abrasive particles which act to physically erode the wafer surface. The slurry is continually added to the spinning CMP pad, and the dual chemical and mechanical forces exerted on the wafer cause it to be polished in a desired manner.

To effectively work over a period of time, a CMP pad needs to be kept in good condition so that distribution of abrasive particles is optimized for each polishing. One method of reducing "glazing" or accumulation of debris on the CMP pad is dressing or conditioning the pad. Dressing refers to attempts made to revive the top of the pad by "combing" or "cutting" it with various devices. Many types of devices and processes have been used for this purpose. Some CMP pad dressers cause the CMP pads to prematurely wear out.

SUMMARY OF THE INVENTION

In accordance with one aspect of the invention, an abrasive tool can be provided and can include an assembly of tool precursors. At least one of the tool precursors can include a continuous polycrystalline diamond or polycrystalline cubic boron nitride, or other ceramic material cutting element formed into a blade shape. The abrasive tool can additionally include a setting material, which is configured to attach the tool precursors and form a single mass. The selection, arrangement, and setting of the tool precursors can result in an abrasive tool having a predetermined cutting configuration.

In accordance with another aspect of the invention, an abrasive tool can be provided and can include an assembly of tool precursors. The tool precursors can include at least one elongated substrate with a continuous polycrystalline diamond, cubic boron nitride (cBN), or other ceramic material cutting element on a surface thereof. The precursor assembly can provide a tool having a surface with a predetermined cutting configuration. The abrasive tool can further include a setting material configured to attach the tool precursors into a single mass that forms the predetermined cutting configuration.

In accordance with another aspect of the invention, a method of forming an abrasive tool can be provided, including providing a plurality of tool precursors. At least one of the tool precursors can have a continuous diamond or cubic boron nitride, or other ceramic cutting element formed in a blade shape. The method can further include securing the tool precursors together to form a tool having a working surface that includes the polycrystalline diamond, cubic boron nitride, or other ceramic material cutting element formed into a blade shape.

In accordance with another aspect of the invention, a CMP pad conditioner can be provided, including a base and a plurality of cutting elements extending from the base. The plurality of cutting elements can each have a cutting tip operable to engage material of the CMP pad. At least some of the cutting elements can have a cutting tip oriented at a different elevation relative to cutting tips of other cutting elements.

In accordance with another aspect of the invention, at least one of the cutting elements can include a cutting tip oriented at a greater elevation, relative to a base of the pad conditioner, than does a cutting tip of an immediately adjacent cutting element.

In accordance with another aspect of the invention, the at least one cutting element abuts the immediately adjacent cutting element.

In accordance with another aspect of the invention, the cutting elements can include a cutting face oriented at 90 degrees or less relative to a surface of the CMP pad conditioned by the cutting elements.

In accordance with another aspect of the invention, the cutting elements can include a trailing edge angled to provide a relief area between the cutting elements and a surface of the CMP pad conditioned by the cutting elements.

In accordance with another aspect of the invention, the cutting elements and the base can be formed from an integral piece of material. In one embodiment, the cutting elements and the base are formed from an integral piece of a polycrystalline diamond compact.

In accordance with another aspect of the invention, the cutting elements can be coupled to the base.

In accordance with another aspect of the invention, at least two of the cutting elements are arranged such that movement of the pad conditioner and the CMP pad relative to one another results in a first, lower elevation cutting element removing material from the CMP pad, followed by a second, higher elevation cutting element removing further material from the CMP pad.

In accordance with another aspect of the invention, a method of conditioning a CMP pad is provided, including: engaging material of the CMP pad with a cutting tip of at least one cutting element; moving the cutting element and the CMP pad relative to one another to thereby remove material from the CMP pad with the cutting tip of the cutting element to create an exposed layer of CMP pad material; engaging the exposed layer of CMP pad material with the cutting tip of the cutting element, or with a cutting tip of a second cutting element; and moving the cutting element engaged with the exposed layer of CMP pad material and the CMP pad relative to one another to thereby remove the exposed layer of CMP pad material.

In accordance with another aspect of the invention, engaging the exposed layer of CMP pad material comprises engaging the exposed layer with the cutting tip of the cutting element used to create the exposed layer.

In one embodiment, engaging the exposed layer of CMP pad material comprises engaging the exposed layer with the cutting tip of the second cutting element.

In accordance with another aspect of the invention, the cutting element and the second cutting element extend from a common base.

In accordance with another aspect of the invention, a method of conditioning a CMP pad is provided, including: removing, with a cutting element, a thin layer of material from the CMP pad; and removing, with the same or a different cutting element, a second layer of material from the CMP, the second layer of material being revealed by removal of the thin layer of material.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

Figure 1:
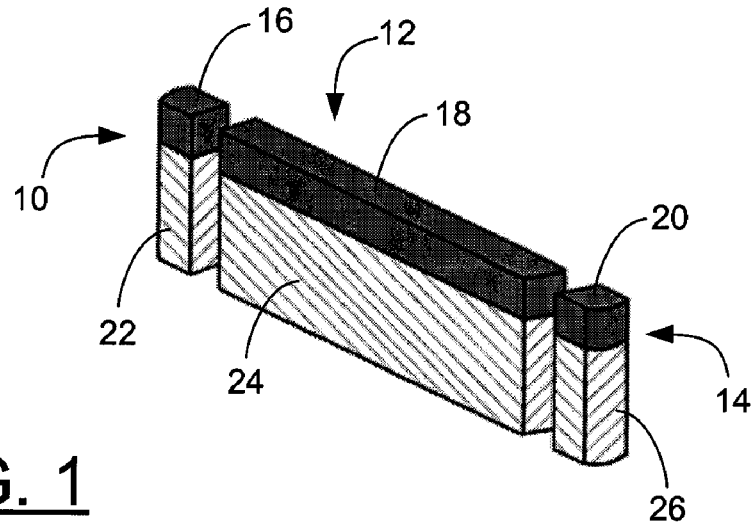
FIG. 1 is a side perspective view of a plurality of tool precursors, in accordance with an embodiment of the present invention.

It will be understood that the above figures are merely for illustrative purposes in furthering an understanding of the invention. Further, the figures are not drawn to scale, thus dimensions and other aspects may, and generally are, exaggerated or changed to make illustrations thereof clearer. Therefore, departure can be made from the specific dimensions and aspects shown in the figures in order to produce abrasive tools or tool precursors of the present invention.

DETAILED DESCRIPTION

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an" and, "the" include plural referents unless the context clearly dictates otherwise. Thus, for example, reference to "a CMP pad dresser" includes one or more of such dressers, reference to "an operating parameter" includes reference to one or more of such operating parameters, and reference to "the asperity" includes reference to one or more of such asperities.

DEFINITIONS

In describing and claiming the present invention, the following terminology will be used in accordance with the definitions set forth below.

As used herein, the term "substantially" refers to the complete or nearly complete extent or degree of an action, characteristic, property, state, structure, item, or result. For example, an object that is "substantially" translucent would mean that the object is either completely translucent or nearly completely translucent. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. In other words, a composition that is "substantially free of" an ingredient or element may still actually contain such item as long as there is no measurable effect thereof.

The terms "dressing" and "conditioning" are interchangeable and refer to the process of rejuvenating a CMP pad by removing debris from the pad, as well as optionally lifting matted fibers and creating new grooves. Likewise, the terms "dresser" and "conditioner" are used interchangeably and indicate the apparatus used for dressing or conditioning.

As used herein, "substrate" means a material which supports or can support a PCD or cBN, or ceramic layer, and to which a PCD or cBN, or ceramic layer may be affixed. Substrates useful in the present invention may be any shape, thickness, or material, that is capable of supporting abrasive particles in a manner that is sufficient provide a tool useful for its intended purpose. Substrates may be of a solid material, a powdered material that becomes solid when processed, or a flexible material. Examples of typical substrate materials include without limitation, metals, metal alloys, ceramics, solidified resins and polymeric materials and mixtures thereof.

As used herein, the terms "base" or "substrate" can be used to refer to a portion of a pad conditioner that supports abrasive materials, and to which abrasive materials may be affixed, or may extend from. Substrates useful in the present invention may be any shape, thickness, or material, that is capable of supporting abrasive materials in a manner that is sufficient provide a pad conditioner useful for its intended purpose. Substrates may be of a solid material, a powdered material that becomes solid when processed, or a flexible material. Examples of typical substrate materials include without limitation, metals, metal alloys, ceramics, relatively hard polymers or other organic materials, glasses, and mixtures thereof. Further the substrate may include material that aids in attaching abrasive materials to the substrate, including, without limitation, brazing alloy material, sintering aids and the like. The substrate and the abrasive cutting elements can, in some embodiments, be formed from the same material and can be formed from an integral, single piece of material.

As used herein, "leading edge" means the edge of a CMP pad dresser that is a frontal edge based on the direction that the CMP pad is moving, or the direction that the pad is moving, or both. Notably, in some aspects, the leading edge may be considered to encompass not only the area specifically at the edge of a dresser, but may also include portions of the dresser which extend slightly inward from the actual edge. In one aspect, the leading edge may be located along an outer edge of the CMP pad dresser. In another aspect, the CMP pad dresser may be configured with a pattern of abrasive particles that provides at least one effective leading edge on a central or inner portion of the CMP pad dresser working surface. In other words, a central or inner portion of the dresser may be configured to provide a functional effect similar to that of a leading edge on the outer edge of the dresser.

As used herein, the process of "brazing" is intended to refer to the creation of chemical bonds between the atoms of the non-metallic, such as diamond, CBN, or ceramic materials and the braze material. Further, "chemical bond" means a covalent bond, such as a carbide, nitride, or boride bond, rather than mechanical or weaker inter-atom attractive forces. Thus, when "brazing" is used in connection with superabrasive particles a true chemical bond is being formed. However, when "brazing" is used in connection with metal to metal bonding the term is used in the more traditional sense of a metallurgical bond. Therefore, brazing of a superabrasive segment to a tool body does not require the presence of a carbide, nitride, or boride former.

As used herein, "ceramic" refers to a hard, often crystalline, substantially heat and corrosion resistant material which may be made by firing a non-metallic material, sometimes with a metallic material. A number of oxide, nitride, and carbide materials considered to be ceramic are well known in the art, including without limitation, aluminum oxides, silicon oxides, boron nitrides, silicon nitrides, and silicon carbides, tungsten carbides, etc.

As used herein, "metallic" means any type of metal, metal alloy, or mixture thereof, and specifically includes but is not limited to steel, iron, and stainless steel.

As used herein, "abrasive profile" is to be understood to refer to a shape or a space defined by abrasive materials that can be used to remove material from a CMP pad. Examples of abrasive profiles include, without limitation, rectangular shapes, tapering rectangular shapes, truncated wedge shapes, wedge shapes, and the like. In some embodiments, the abrasive profile exhibited by abrasive segments of the present invention will apparent when viewed through a plane in which the CMP pad will be oriented during removal of material from the CMP pad.

As used herein, "superhard" may be used to refer to any crystalline, or polycrystalline material, or mixture of such materials which has a Mohr's hardness of about 8 or greater. In some aspects, the Mohr's hardness may be about 9.5 or greater. Such materials include but are not limited to diamond, polycrystalline diamond (PCD), cubic boron nitride (cBN), polycrystalline cubic boron nitride (PcBN), corundum and sapphire, as well as other superhard materials known to those skilled in the art. Superhard materials may be incorporated into the present invention in a variety of forms including particles, grits, films, layers, pieces, segments, etc. In some cases, the superhard materials of the present invention are in the form of polycrystalline superhard materials, such as PCD and PcBN materials.

As used herein, "organic material" refers to a semisolid or solid complex amorphous mix of organic compounds. As such, "organic material layer" and "organic material matrix" may be used interchangeably, refer to a layer or mass of a semisolid or solid complex amorphous mix of organic compounds. Preferably the organic material will be a polymer or copolymer formed from the polymerization of one or more monomers.

As used herein, "particle" and "grit" may be used interchangeably.

As used herein, the term "abrasive" can be used to describe a variety of structures capable of removing (e.g., cutting, polishing, scraping) material from a CMP pad. An abrasive can include a mass having several cutting points, ridges or mesas formed thereon or therein. It is notable that such cutting points, ridges or mesas may be from a multiplicity of protrusions or asperities included in the mass. Furthermore, an abrasive can include a plurality of individual abrasive particles that may have only one cutting point, ridge or mesa formed thereon or therein. An abrasive can also include composite masses, such as PCD pieces, segment or blanks, either individually comprising the abrasive layer or collectively comprising the abrasive layer.

As used herein, the term "cutting tip" is generally used to refer to a portion of a cutting element that engages and removes material from a workpiece (generally a CMP pad). "Cutting tips" can include points, edges, surfaces, etc., that are capable of cutting material from a CMP pad. The terms "cutting tip," "edge," "blade," etc., can be, but are not always, used interchangeably.

As used herein, a plurality of components may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, particle sizes, volumes, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

The Invention

It has been found that the overall CMP process can be improved through dressing or conditioning with a CMP pad dresser that effectively dresses the CMP pad, so as to optimally allow for extended CMP pad life, while reducing glazing and other negative effects on the CMP pad. Such improvements can occur as a result of precisely-machined CMP pad dressers. By utilizing dressers as disclosed herein, CMP pads can be refreshed, without losing CMP pad life as with the use of typical CMP pad dressers. Furthermore, the methods disclosed herein for creating such dressers provide a relative fast and economical way to create such precise tools. Additionally, the method provides for the creation of a CMP pad dresser that has a predetermined working surface.

In accordance with embodiments presented herein, various details are provided which are applicable to each of the CMP pad dressers and method for creating or forming the CMP pad dressers. Thus, discussion of one specific embodiment is related to and provides support for this discussion in the context of the other related embodiments.

Figure 2:
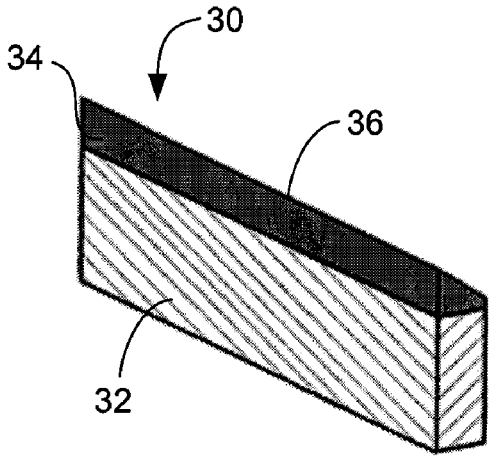
FIG. 2 is a side perspective view of a tool precursor having a PCD or cBN, or ceramic layer in a blade formation, in accordance with an embodiment of the present invention.
Figure 3:
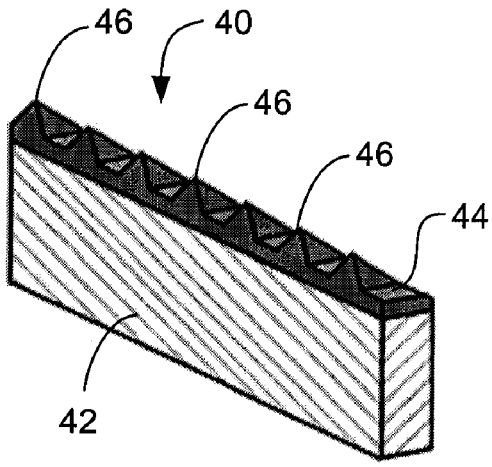
FIG. 3 is a side perspective view of a tool precursor having a PCD or cBN, or ceramic layer formed in a plurality of asperities, in accordance with an embodiment of the present invention.

An abrasive tool can include an assembly of tool precursors. Tool precursors can be of a variety of shapes and sizes. FIGS. 1-3 illustrate a plurality of tool precursors. FIG. 1 illustrates three tool precursors 10, 12, 14. Each of the illustrated precursors includes a polycrystalline diamond (PCD), cubic boron nitride (PcBN), or ceramic layer 16, 18, 20, on one surface of a substrate 22, 24, 26, of the tool precursor. In each embodiment, the layer could alternatively comprise or consist essentially of either PCD or PcBN. Additionally, the layer may comprise or consist of diamond in other forms, including CVD deposited diamond and also various ceramic materials. In one embodiment (not shown), the layer may be a ceramic or PcBN layer which is overlayed with an outer layer of CVD diamond. The layers illustrated are substantially uniform in thickness across the full area of the surface of the substrate. Tool precursor 12 illustrates an elongated tool precursor having a continuous polycrystalline diamond or polycrystalline cubic boron nitride cutting element formed thereon. In one embodiment, the tool precursor 12 of FIG. 1 can be further machined to form a blade shape as illustrated in FIG. 2. As shown, the tool precursor 30 includes an elongated substrate 32 and a continuous polycrystalline diamond or cubic boron nitride cutting element 34 on a surface of the substrate. The cutting element is formed into of a blade shape, having a single tip 36 of the cutting element substantially along the length the elongated tool precursor.

It should be understood that while much discussion is directed to PCD, diamond, PcBN, and/or cubic boron nitride cutting elements, other materials can be used as the cutting element, either alone or in combination with other materials, and are to be included in the scope of the disclosure herein. For example, the cutting element can comprise or consist essentially of ceramics, or other diamond or cBN films, including those deposited via chemical vapor deposition (CVD). Non-limiting examples of ceramics that can be used as a cutting element include alumina, aluminum carbide, silica, silicon carbide, silicon nitride, zirconia, zirconium carbide, and mixtures thereof. Cutting elements can be, in one embodiment, sintered masses, partially sintered masses, and/or layers of material attached to the substrate of the tool precursor according to any method known in the art. The cutting element can, in one aspect, include a mixture, homogeneous or otherwise, of a plurality of materials, optionally including abrasive particles. In another aspect, the cutting element can include a plurality of layers of material. As a non-limiting example, the cutting element can include a ceramic overcoated with CVD diamond.

Figure 10:
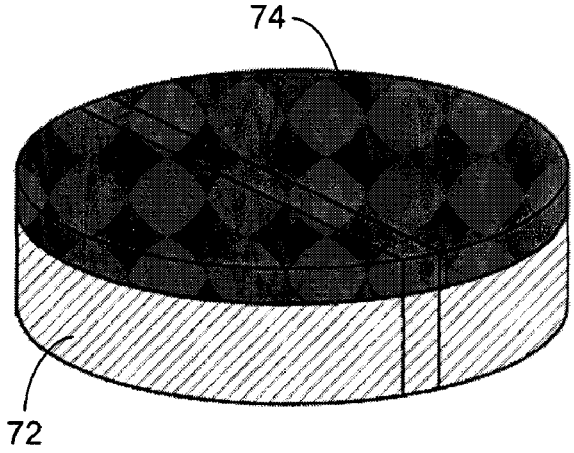
FIG. 10 is a perspective view of a mass from which tool precursors can optionally be formed, in accordance with an embodiment of the present invention.

In one aspect, the tool precursor of FIG. 2 can be further machined to form a plurality of asperities as illustrated in FIG. 3. As shown, the tool precursor 40 has an elongated substrate 42 with a continuous polycrystalline diamond or cubic boron nitride cutting element 44 on one surface of the substrate. The diamond or cubic boron nitride cutting element is formed into a plurality of asperities 46 having a single tip or point. As shown, the asperities are of a pyramidal shape. Although pyramidal shape is illustrated as the asperity shape, any shape having a tip that can form an asperity is to be explicitly included herein. Regarding pyramidal shapes, the pyramidal shaped asperities can include irregular and regularly shaped pyramids. Such asperities can include any three-dimensional shape having triangular non-base surfaces that converge on one point. The base shape is typically quadrilateral or trilateral, but can be any polygon shape. In the case of FIG. 3, pyramid shaped asperities having a triangular base are shown and such pyramids have a substantially flat vertical side as will be explained in more detail. Alternatively, pyramids with a cubic base could be used. One of the faces of the pyramidal asperities of FIG. 3 is substantially perpendicular to the plane of the substrate surface. In such case, it is possible to pair two similar tool precursors in a back-to-front manner so as to form a pyramid shape having a larger base, i.e. each tool precursor would provide approximately one half of the asperity. In the case of arranging the tool precursors of FIG. 3 in a back-to-front manner, the pyramids formed by aligning two of the tool precursors together to form a single line of pyramidal asperities have a quadrilateral base shape, with half of each base being provided by a single tool precursor. In one embodiment, tool precursors of the present invention can be prepared by forming a PCD or PcBN blank with a PCD or PcBN layer attached to a substrate as shown in FIG. 10, and an elongated segment can be removed as shown. Next, an electro discharge machining (EDM) wire can be used to form the tool precursors by shaping the PCD or PcBN layer of each segment. The precursors can then be assembled into a finished tool.

In one aspect, a substrate having a continuous PCD or PcBN layer can be formed into a blade shape, either through EDM wire or other grinding or material removal method. Such blade shape is illustrated in FIG. 2. With the blade shape formed, asperities can be formed through use of EDM wire, or other precise material removal method. In forming asperities from a blade shape, the asperities can be formed immediately adjacent to each other, or can be spaced. The angles of each asperity can be uniform or non-uniform. The EDM wire and other tools are easily used to sculpt the PCD or PcBN of the segments because of the fact that the individual segments present a two dimensional area to be carved rather than a three dimensional area that would have portions not easily accessible by the wire.

As noted, the abrasive tool is an assembly of tool precursors. The assembly can include any number of tool precursors, and can include tool precursors of varying design. Alternatively, the assembly can include a plurality of tool precursors having substantially the same shape and cutting elements. The assembly can be arranged so as to have a pattern of cutting element design. In one embodiment, an alternating design may be desirable. Furthermore, assembly of the tool precursors can include varying the height dimension, or the difference of asperity or blade projection in relation to adjacent tool precursors to effectuate a particular predetermined cutting configuration.

Figure 4:
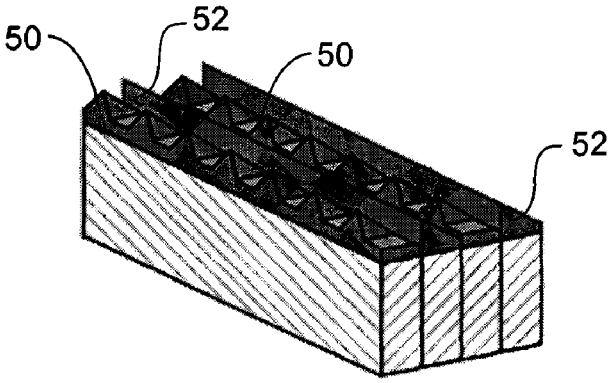
FIG. 4 is a side perspective view of an assembly of tool precursors, in accordance with an embodiment of the present invention.
Figure 5:
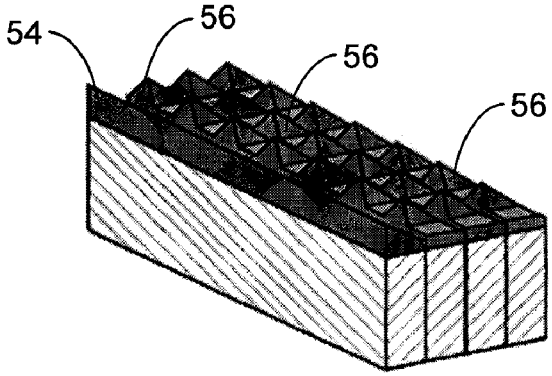
FIG. 5 is a side perspective view of an assembly of tool precursors, in accordance with an embodiment of the present invention.
Figure 6:
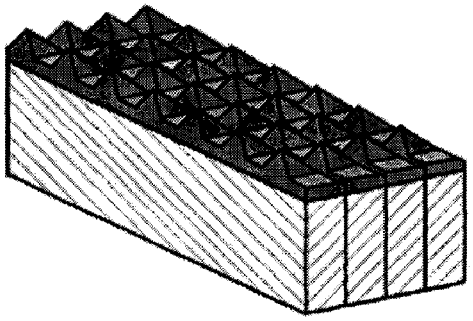
FIG. 6 is a side perspective view of an assembly of tool precursors, in accordance with an embodiment of the present invention.
Figure 7:
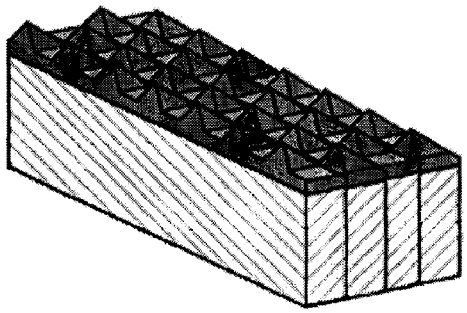
FIG. 7 is a side perspective view of an assembly of tool precursors, in accordance with an embodiment of the present invention.

Non-limiting examples of arrangement of tool precursors includes alternating, as illustrated in FIG. 4, with alternating asperities 50 and blades 52 tool precursors; leading as in FIG. 5, with a blade 54 on one end and a plurality of asperity tool 56 precursors attached thereto; a following pattern as in FIG. 6, with a plurality of asperities aligned such that each tip is substantially in line with the asperities of the adjacent tool precursors; and offset patterns as in FIG. 7 with a plurality of tool precursors having asperities, where the asperities are aligned so as to not be in line with the asperities of the adjacent tool precursors. It should be noted that the illustrations are non-limiting arrangements of the tool precursors. Those illustrated could be combined in various ways. Additionally, blanks could be used in a variety of ways with patterns and predetermined placement so as to create a predetermined cutting configuration. Blanks can include simple substrate without PCD, or could include a layer of PCD or PcBN, continuous or discontinuous, as an unformed layer or coating. Furthermore, the arrangements illustrated do not account for the variety obtained from orienting one or more tool precursor in a reverse direction, such as the back-to-front orientation with the pyramidal shaped asperities. Such orientation of the tool precursors greatly increases the possibilities available for creating a cutting configuration. It should also be noted that the assemblies of tool precursors illustrated in FIGS. 4-7 can, along with a setting material, constitute the abrasive tool, or they may alternatively be a portion of an assembly of tool precursors in an abrasive tool.

Substrates used in the abrasive tool can be of a variety of compositions and shapes. In one aspect, the substrate can comprise or consist essentially of metals, metallics, ceramics, organics, and combinations thereof. Furthermore, the substrate can be directly in contact with the PCD or PcBN layer, or may include a layer, continuous or discontinuous, along the interface of the PCD or PcBN and substrate.

Forming an abrasive tool includes providing a plurality of tool precursors and securing the tool precursors together, into a tool having a working surface. The working surface can include a polycrystalline diamond or polycrystalline cubic boron nitride cutting element thereon. Securing the tool precursors together can include a variety of steps. In one aspect, a setting material can be used to form the consolidated tool. Non-limiting examples of steps used to secure the assembly of tool precursors include brazing, soldering, sintering, cementing, and combinations thereof. As such, setting materials can include braze material, soldering material, sintering agents, cementing material, organic materials including polymeric materials and resins, and combinations thereof. Furthermore, a setting material can include an adhesive.

Figure 8:
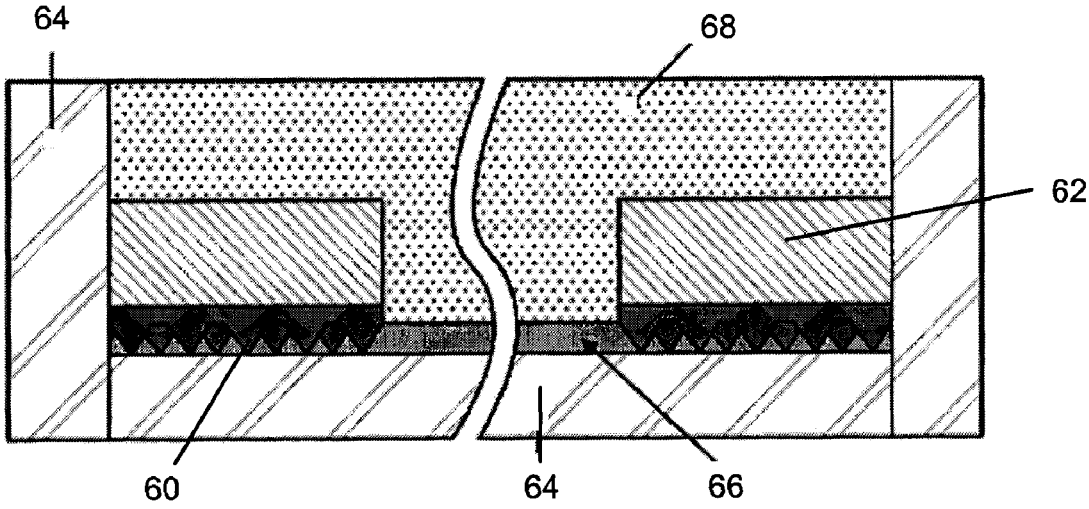
FIG. 8 is a side view of a tool precursors leveled and set in an epoxy, thus forming an abrasive tool, in accordance with an embodiment of the present invention.

Any process and any related material or materials can be used to set the tool precursors into a single mass. Such materials can be distributed or used between some or each of the tool precursors, or can be used to encompass that thereby set the tool precursors. One non-limiting example of a process that can be used to secure abrasive tool precursors can include securing the abrasive precursors with an organic material. The abrasive precursors can be arranged as desired against a steel or other plate, with the asperity, blade, or other tips arranged as desired. In the illustrated case of FIG. 8, the tips 60 of the asperities of the tool precursors 62 are arranged against a plate 64 so as to be level. The tips can be covered with an adhesive or other covering 66, and then an epoxy 68 can be placed over the arranged tool precursors. In one aspect, the epoxy can be reinforced with glass fibers, color-coded with pigments, reinforced with backing, or any combination thereof. Once the epoxy is cured, the tool precursors are arranged and set in a manner so as to provide a desired cutting surface. It should be noted that arranging the asperities and other tips in a level manner is illustrated by the example, however such arrangement is only one embodiment of the present method and tool. It can be beneficial to deliberately arrange the tips tool precursors so as to provide for a vertical pattern, such that the asperity and other tips or points protrude different amounts from the working surface.

Various reverse casting methods may be utilized to set the tool precursors into a single mass. For example, a spacer layer of a material sufficiently soft so as to allow penetration of at least a tip portion of the precursors thereinto, may be applied to a working surface of a temporary substrate. The tool precursors can be arranged so that at least a portion of the cutting element of each precursor is at least partially embedded in the spacer layer and comes in contact with, or nearly in contact with, the temporary substrate. In one aspect, the tool precursors can be pressed by any mechanism or means such that the tips of asperities and/or blades come into contact with the temporary substrate. In this manner, the temporary substrate can define the final leveling contour of the assembled mass. As such, the temporary substrate can include any contour, levelness, slope, stepped, etc., according to the desired contours of the assembled mass. In an alternative aspect, the spacer layer may be optional. In yet another aspect, the spacer may be an adhesive or other organic resin.

An adhesive may be optionally applied to the temporary substrate and/or the spacer layer and/or the cutting elements to facilitate proper arrangement and temporary attachment. The adhesive used on any noted surface may be any adhesive known to one skilled in the art, such as, without limitation, a polyvinyl alcohol (PVA), a polyvinyl butyral (PVB), a polyethylene glycol (PEG), a pariffin, a phenolic resin, a wax emulsion, an acrylic resin, or combinations thereof. In one aspect, the fixative is a sprayed acrylic glue.

The spacer layer may be made from any soft, deformable material with a relatively uniform thickness, and may be selected according to particular needs of manufacturing, future use, compositional considerations of tool precursors, etc. Examples of useful materials include, but are not limited to, rubbers, plastics, waxes, graphites, clays, tapes, grafoils, metals, powders, and combinations thereof. In one aspect, the spacer layer may be a rolled sheet comprising a metal or other powder and a binder. For example, the metal may be a stainless steel powder and a polyethylene glycol binder. Various binders can be utilized, which are well known to those skilled in the art, such as, but not limited to, a polyvinyl alcohol (PVA), a polyvinyl butyral (PVB), a polyethylene glycol (PEG), a pariffin, a phenolic resin, a wax emulsions, an acrylic resin, and combinations thereof.

An at least partially uncured resin material can be applied to the spacer layer opposite of the temporary substrate. A mold, e.g. of stainless steel or otherwise, may be utilized to contain the uncured resin material during manufacture. Upon curing the resin material, a resin layer is formed, cementing at least a portion of tool precursor. Optionally, a permanent tool substrate may be coupled to the resin layer to facilitate its use in dressing a CMP pad or use in dressing a CMP pad or in other uses. In one aspect, the permanent substrate may be coupled to the resin layer by means of an appropriate adhesive. The coupling may be facilitated by roughing the contact surfaces between the permanent substrate and the resin layer. In another aspect, the permanent substrate may be associated with the resin material, and thus become coupled to the resin layer as a result of curing.

The mold and the temporary substrate can subsequently be removed from the CMP pad dresser once the resin is cured. Additionally, the spacer layer can be removed from the resin layer. This may be accomplished by any mechanism known in the art including peeling, grinding, sandblasting, scraping, rubbing, abrasion, etc. Therefore, the protrusion of the tool precursors from the resin is dependent on the amount covered or concealed by the spacer layer. Additionally, the arrangement of the tool precursors is relatively fixed by the resin. As such, the tool precursors can be placed in a variety of configurations, thus creating a variety of configurations of a surface of an assembled tool.

Figure 9:
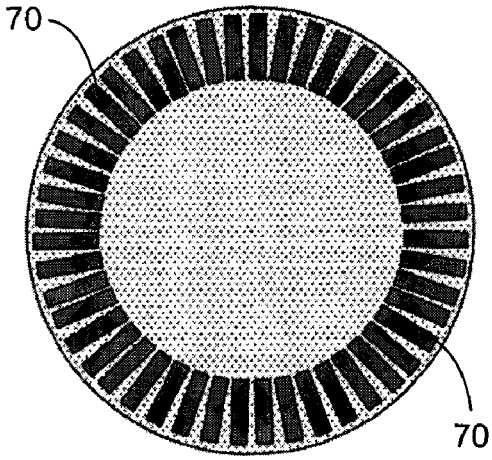
FIG. 9 is a top view of an abrasive tool having tool precursors arranged in a spoke formation, in accordance with an embodiment of the present invention.

Furthermore, the tool precursors can be set in a parallel formation, such as illustrated in FIGS. 4-7, or can be placed in any arrangement that forms a desired cutting configuration. In one aspect, the tool precursors can be arranged in a spoke formation as illustrated in FIG. 9, wherein the tool precursors 70 are arranged as spokes of a wheel of the illustrated circular abrasive tool.

Tool precursors can be arranged at various angles to form abrasive tools. Blades can be angled to better interact with the various materials they contact. For example, it may be found that angling a blade shaped tool precursor at a specific angle, or angling a plurality of blade shaped tool precursors at differing angles, can better handle material removal from a CMP pad.

In one embodiment, the tool precursors can be formed from a single mass. For example, a substrate, such as tungsten carbide, can be formed into a desired overall tool shape. Such formation of the overall tool is not required. In FIG. 10, however, a single substrate 72 is formed into a truncated cylindrical shape. One of the circular surfaces can be covered with a PCD or PcBN layer 74. A continuous layer is illustrated in the figure; however, a discontinuous layer could likewise be used. With the PCD or PcBN layer on the substrate, the individual tool precursors can be cut from the overall piece shown in FIG. 10. Once cut from the larger body, they can be of the form illustrated in FIG. 1, or any other shape cut from the larger body. Once cut, they can be further shaped, if desired. Once the tool precursors are formed, they can be optionally returned to the larger body, wherein each piece includes an inverse-image of neighboring surfaces as from being cut from the same original mass. Thus would form an abrasive tool having a substantially continuous PCD or PcBN layer, supposing the original mass included a substantially continuous PCD or PcBN layer. Optionally, only portions of the original mass can be reformed into the abrasive tool. In such case, the working surface of the abrasive tool may or may not include a substantially continuous PCD or PcBN layer, depending on the tool precursors selected to form the abrasive tool.

Figure 11:
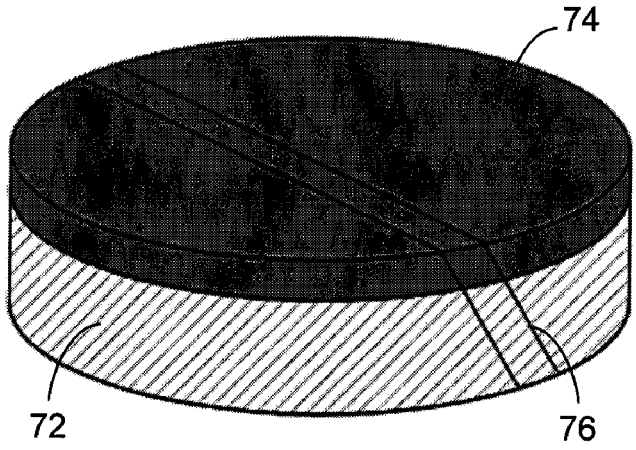
FIG. 11 is a perspective view of a mass from which tool precursors can optionally be formed, in accordance with an embodiment of the present invention.
Figure 12:
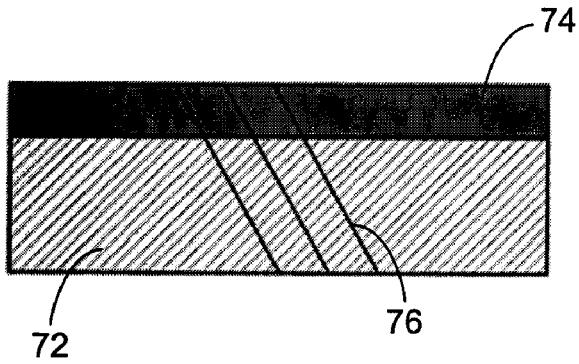
FIG. 12 is a side view of a mass, similar to FIG. 11, from which tool precursors can optionally be formed, in accordance with an embodiment of the present invention.
Figure 13:
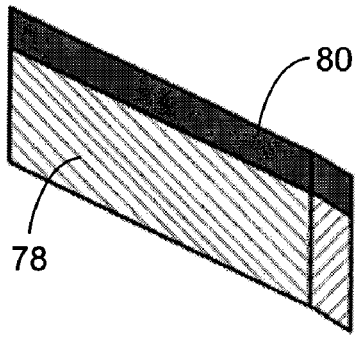
FIG. 13 is a side perspective view of a tool precursor having a PCD or CBN or ceramic layer in a blade formation, in accordance with an embodiment of the present invention.

In another embodiment, another overall piece, such as that shown in FIG. 10, can be cut at a different angle, as illustrated in FIG. 11. As with FIG. 10, FIG. 11 depicts a single substrate 72 formed into a truncated cylindrical shape, with one of the circular surfaces covered with a PCD or PcBN layer 74. In this case, however, the overall piece is cut at a plane between perpendicular and parallel to the surface of the PCD or PcBN layer. A view of the side of the overall piece, including an additional cutting line and illustrating the cutting angle of FIG. 11 is illustrated in FIG. 12. Cutting or dividing the overall piece at an angle can produce a tool precursor as shown in FIG. 13, having an elongated substrate 78 and a continuous polycrystalline diamond or continuous polycrystalline cubic boron nitride, or other ceramic material cutting element 80 on a surface of the substrate. The cutting element is formed into a blade shape, having a single tip of the cutting element substantially along the length the elongated tool precursor, as a result of cutting the tool precursor from the overall piece. To compare, the tool precursor of FIG. 13 is similar to the tool precursor of FIG. 2, where the FIG. 2 tool precursor has been cut and undergone a shaping step to produce the blade formation. One notable difference between the two tool precursors is the flat base of the elongated substrate in FIG. 2 versus the angled base of the elongated substrate of FIG. 13.

Figure 14:
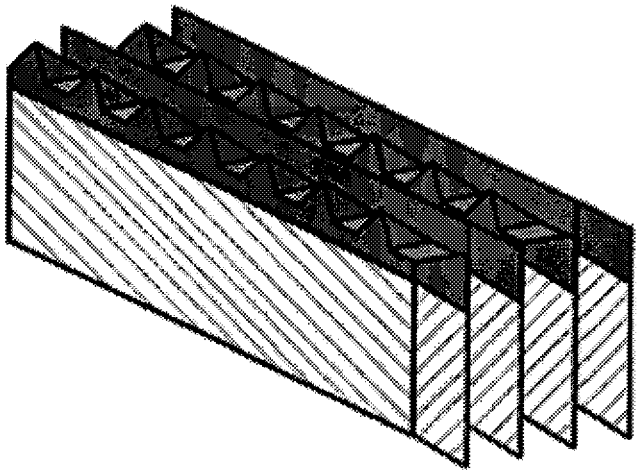
FIG. 14 is a side perspective view of an assembly of tool precursors, in accordance with an embodiment of the present invention.

The cutting element of the abrasive tool precursors of FIG. 13 can be further shaped as with the other tool precursors disclosed herein. In a specific embodiment, a plurality of asperities can optionally be formed of the blade shape of the cutting element. Furthermore, the cutting elements having the angled base can be assembled as with other tool precursors disclosed herein. One non-limiting example is illustrated in FIG. 14, wherein abrasive precursors having a blade shaped cutting element and those having pyramidal asperities are alternated. It should be noted that blanks, i.e. substrates having no cutting element, other spacers, and other configurations of tool precursors in patterned or random arrangement are contemplated by the present disclosure. Furthermore, the tool precursors having angled bases and those having flat bases can be used in combination to form abrasive tools.

Figure 15:
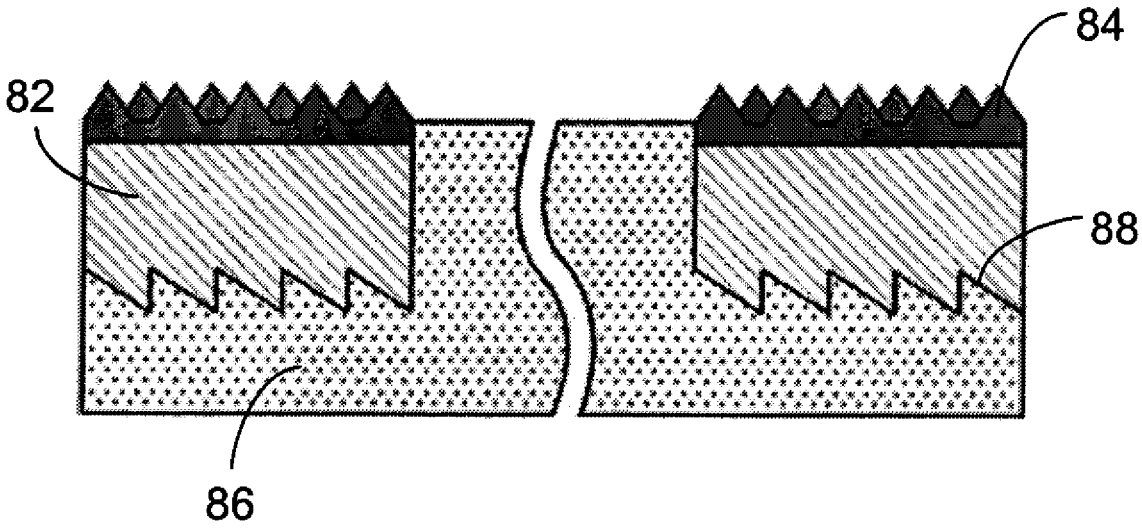
FIG. 15 is a side cross-sectional view of an abrasive tool, in accordance with an embodiment of the present invention.

As with previously-disclosed tool precursors, the tool precursors having a angled bases can be included in an abrasive tool. Such tool precursors can be included along with other tool precursors, or the abrasive tool can be composed of tool precursors only having the angled bases. An example abrasive tool is shown as FIG. 15, wherein the substrates 82 and cutting element 74, in this embodiment, each shaped with a plurality of asperities, are held together with an epoxy 86. Such tool can be manufactured according to the methods disclosed herein, particularly with respect to the discussion around FIG. 8, and the resulting tool differs from previous embodiments primarily in that the base of the tool precursors is angled and thus creates a zig-zag design along the epoxy interface 88.

Figure 21:
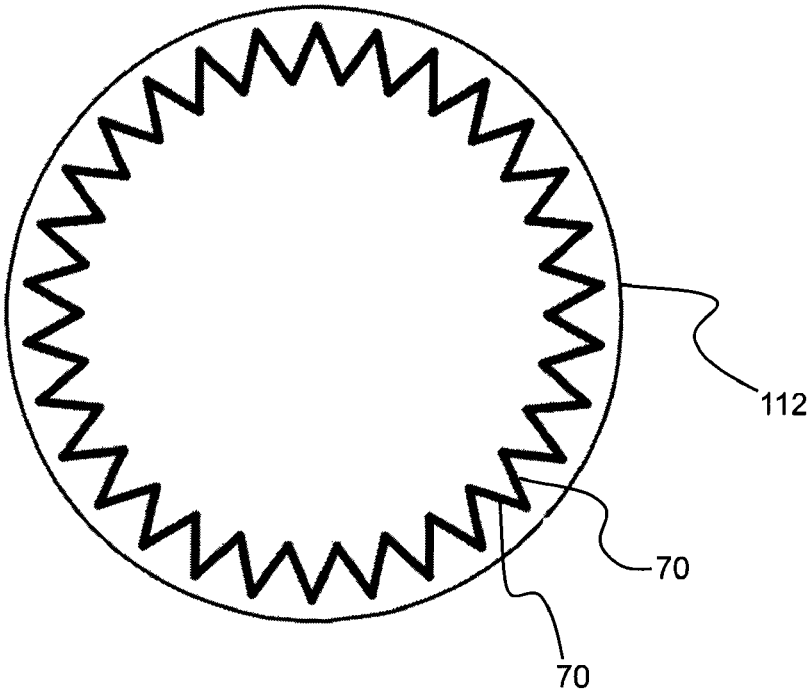
FIG. 21 is a top view of another exemplary pad conditioner illustrating one possible arrangement of cutting elements across the face of the pad conditioner.
Figure 22:
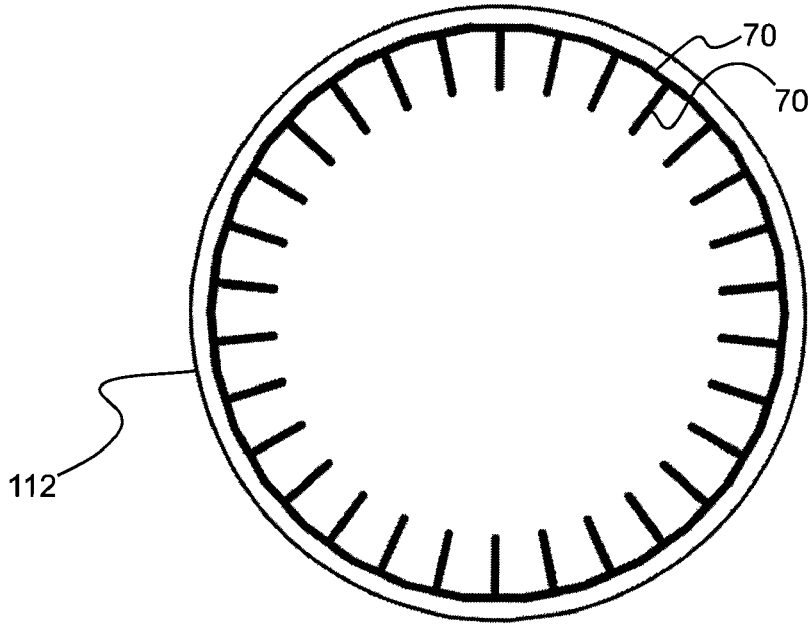
FIG. 22 is a top view of another exemplary pad conditioner illustrating one possible arrangement of cutting elements across the face of the pad conditioner.
Figure 23:
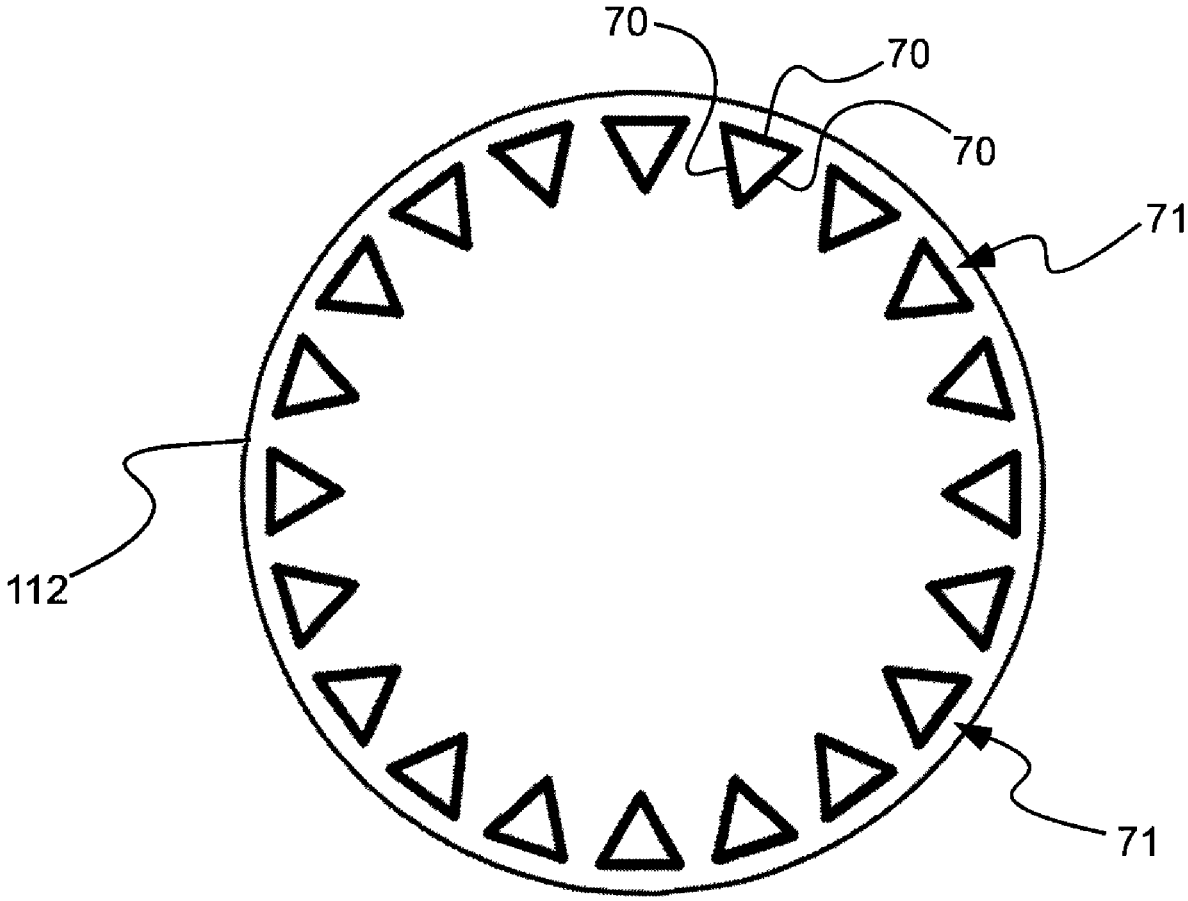
FIG. 23 is a top view of another exemplary pad conditioner illustrating one possible arrangement of cutting elements across the face of the pad conditioner.

FIGS. 21-23 illustrate various other manners in which the tool precursors or cutting elements 70 can be arranged on the abrasive tool or pad dresser 112 to maximize particular abrading functions while minimizing possible damage to the pad or workpiece being abraded. In these embodiments, the precursors or cutting elements are arranged such that the pad dresser or abrasive tool can "sweep" across the pad and completely, or nearly completely, dress the pad without internal features of cutting elements catching or "snagging" the pad to cause unwanted asperities.

As will appreciated, a periphery of any particular cutting element (or precursor) "knot" or assemblage is closed, such that the precursor assemblage can approach a portion of a pad (or the pad can approach the precursor assemblage) from any angle without having internal angles formed by the precursors "snag" on the pad material. Also, using this technique, more of the cutting tips can be faced outwardly (from any particular assemblage of cutting elements or precursors) in the direction of pad movement. The inner side can contain fewer cutting tips for less work (and less wear). In essence, one precursor (or cutting element) assemblage is defined in the embodiments of FIGS. 21 and 22 (each assemblage formed from a plurality of the precursors 70), whereas a plurality of knots or assemblages 71 are illustrated in FIG. 23, each formed from 3 precursors 70.

Figure 20:
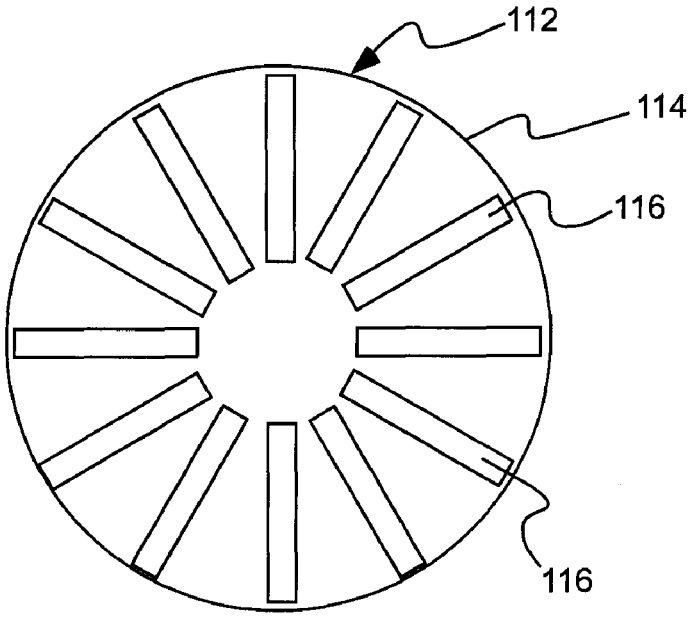
FIG. 20 is a top view of an exemplary pad conditioner illustrating one possible arrangement of cutting elements across the face of the pad conditioner.

Turning now to FIGS. 16-20, in accordance with another aspect of the invention, various cutting devices and associated methods are provided that can be used to remove material from a CMP pad 118 in a manner that creates a smooth and even surface on the CMP pad. In accordance with one embodiment, the invention provides a CMP pad conditioner (shown by arbitrary example 112 in FIG. 20) that can include a base (e.g., 114 in FIG. 20) and a plurality of cutting elements 116 extending from the base. The cutting elements 116 shown in FIG. 20 are shown in one exemplary orientation showing one manner of spacing, placement, relative size, etc., of the cutting elements. Other embodiments can include a variety of differing sizes of cutting elements or blades, different physical layouts (e.g., spacing, angular arrangement, etc.), lengths of cutting elements or blades, etc., are also encompassed by the present invention.

Figure 16:
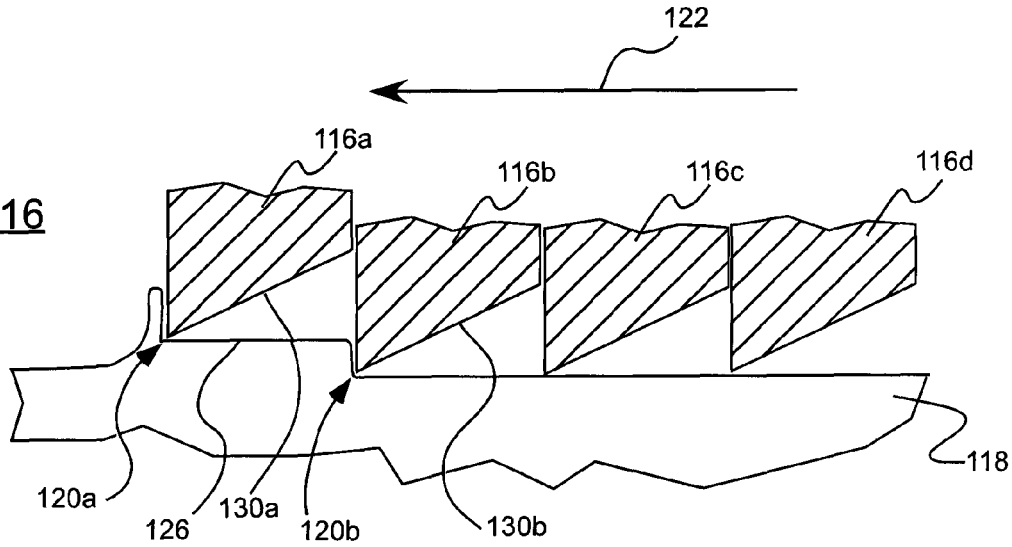
FIG. 16 is a side view of a pad conditioner engaging a CMP pad in accordance with an embodiment of the invention.

As shown in FIG. 16, the cutting elements 116*a*, 116*b*, etc., can each have a cutting tip 120*a*, 120*b*, etc., that is operable to engage material of the CMP pad 118. At least some of the cutting elements can have a cutting tip oriented at a different elevation relative to cutting tips of other cutting elements. For example, in the embodiment illustrated in FIG. 16, cutting tip 120*a* of cutting element 116*a* is oriented at a lower elevation than is cutting tip 120*b* of cutting element 116*b* (it is noted that, as used herein, the term "elevation" is used only to compare relative distances of elements, and does not limit the invention to orientations in a vertical plane).

In the aspect shown in FIG. 16, the pad 118 and the cutting elements 116 are moved relative to one another (e.g., the cutting elements can be moved in the direction indicated at 122) to remove material from the pad. As the cutting elements and pad are moved relative to one another, the leading cutting element 116*a* first engages the material of the pad and can remove a relatively thin layer of pad material. As the cutting elements progress over the pad material, trailing cutting element 116*b* engages the pad material and removes an additional thin layer of material. Thus, the pad material can be incrementally removed in thin layers until a smooth, even surface is applied to the pad.

In the embodiment shown in FIG. 11, the leading cutting element 116*a* includes a cutting tip 120*a* that is oriented at a greater elevation (relative to a base of the pad conditioner, which would be positioned above the cutting elements shown FIG. 16) than does the cutting tip 120*b* of immediately adjacent cutting element 116*b*. The embodiment of FIG. 16 also includes a pair of secondary trailing cutting elements 116*c*, 116*d* having cutting tips that are aligned at about the same elevation as cutting tip 120*b*. In this embodiment, the cutting tips 120*a* and 120*b* perform the work of removing thin layers of the pad material, while the secondary trailing cutting elements (116*c*, 116*d*) can perform very fine smoothing of any bumps or ridges remaining after the pass of cutting tips 120*a* and 120*b*.

In the embodiment shown in FIG. 16, the cutting elements are positioned so as to abut one another and pass over (and/or through) the pad material in rapid succession. It will be appreciated from FIG. 17 that the cutting elements can also be spaced some distance from another. This aspect of the invention can be advantageous in that the pad material may be deformed slightly by the leading cutting element, and may be given time to return to a relaxed condition prior to the succeeding trailing blade passing over the location recently cut or conditioned by the leading blade.

Figure 17:
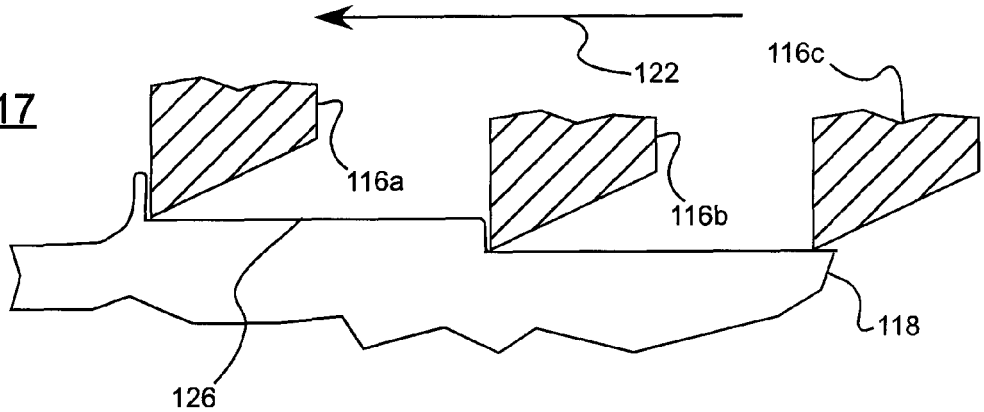
FIG. 17 is a side view of another pad conditioner engaging a CMP pad in accordance with an embodiment of the invention.
Figure 18:
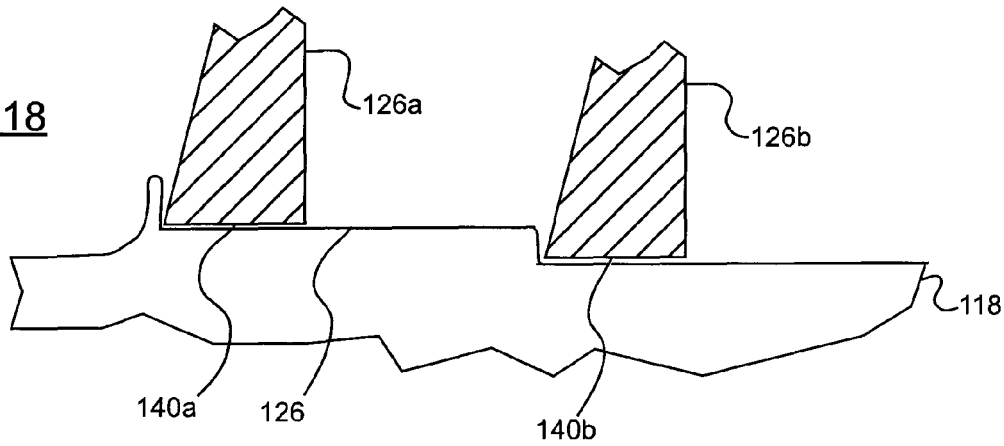
FIG. 18 is a side view of another pad conditioner engaging a CMP pad in accordance with an embodiment of the invention.
Figure 19:
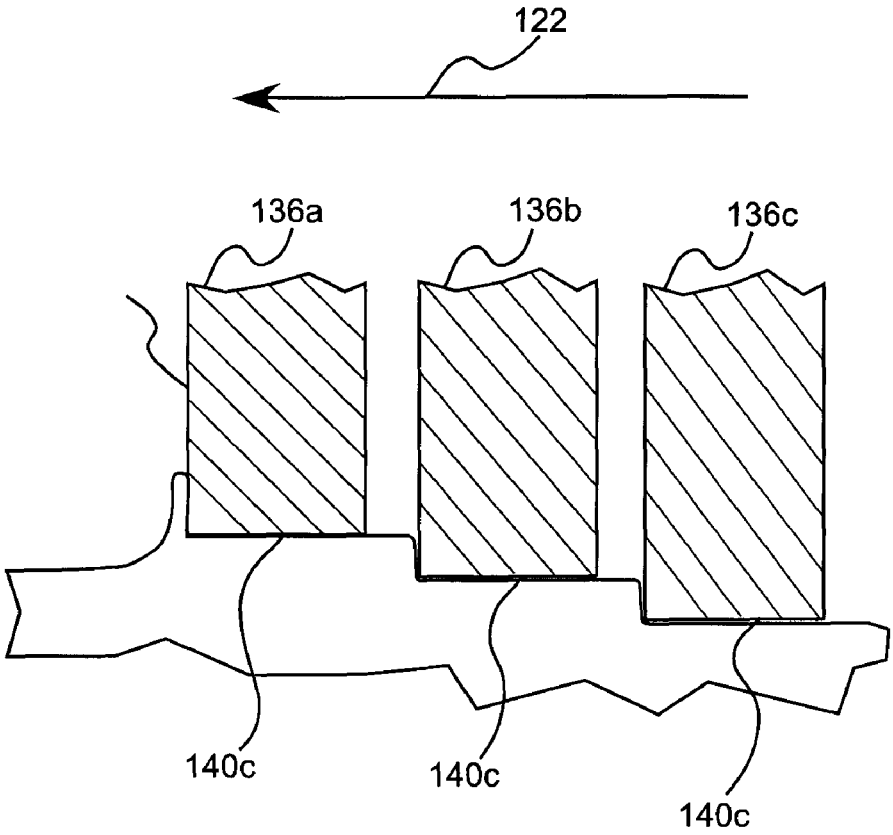
FIG. 19 is a partial view of a pad being conditioned in accordance with another embodiment of the invention.

While not so required, in one embodiment of the invention, the cutting elements can include a cutting faces (122*a*, for example) that are oriented at 90 degrees or less relative to a surface 126 of the CMP pad that is formed by the cutting elements. The cutting faces of the cutting elements shown in FIGS. 16 and 17 are formed at about 90 degrees, while the cutting faces of the cutting elements shown in FIG. 18 are formed at an angle less than 90 degrees relative to the surface 126 formed on the pad material. In addition, the faces of the cutting blades can be curved or arcuate in nature.

In the embodiment shown in FIGS. 16 and 17, the cutting elements include a trailing edge 130*a*, 130*b*, etc. that is angled to provide a relief area between the cutting elements and the conditioned surface 126 of the CMP pad created by the cutting elements. However, as shown in FIG. 18, the trailing edges 140*a*, 140*b*, etc. can also be formed in a substantially parallel relationship with the surface 126 created on the pad material by the cutting elements.

It will be appreciated that the number of cutting elements, and the relative elevational position of the cutting tip of each cutting element, can vary. In the embodiment illustrated in FIG. 19, three cutting elements 136*a*, 136*b* and 136*c* are provided, each including a different elevation. In other embodiments, the cutting tips of two or more cutting elements can share a substantially common elevation, while others are staggered upwardly or downwardly relative to this common elevation. In some embodiments, leading blades (e.g., blades that will first contact the pad material) will be at a relatively higher elevation than are trailing blades, as the trailing blades would not otherwise contact pad material remaining after the leading blade has passed. One exception to this generalization may be in the case of pad conditioners that include trailing blades that are slightly higher than an adjacent leading blade, in the case clean up of very rough surfaces created by the leading blade requires removal of protrusions created by the leading blade. In other embodiments, many of the blades may share a common elevation. The variety of differing configurations made possible by the present invention provides a great deal of flexibility in tailoring pad conditioners for specific applications.

The cutting elements or blades can be formed in a variety of manners. One embodiment includes forming the cutting elements from a polycrystalline diamond compact or a polycrystalline cubic boron nitride compact (individual cutting elements can be formed from the compacts and attached to the base, or the base and the cutting elements can be formed from an integral piece of the compact).

In another aspect, the cutting elements can be formed by creating a sintered alumina plate having the basic shape of the cutting elements extending therefrom. A layer of DLC can be coated over this resulting patterned surface. Also, CVDD can be coated over a patterned surface of ceramic. In addition, a sintered SiC plate (with molten silicon used to infiltrate the pores) can be used. In another embodiment, sintered silicon nitride (Si3N4) can be used.

In addition, other materials can be used as the cutting elements or blades, either alone or in combination with other materials, and are to be included in the scope of the disclosure herein. For example, the cutting element can comprise or consist essentially of ceramics, or other diamond or cBN films, including those deposited via chemical vapor deposition (CVD).

Non-limiting examples of ceramics that can be used as a cutting element include alumina, aluminum carbide, silica, silicon carbide, silicon nitride, zirconia, zirconium carbide, and mixtures thereof. Cutting elements can be, in one embodiment, sintered masses, partially sintered masses, and/or layers of material attached to the substrate of the tool precursor according to any method known in the art. The cutting element can, in one aspect, include a mixture, homogeneous or otherwise, of a plurality of materials, optionally including abrasive particles. In another aspect, the cutting element can include a plurality of layers of material. As a non-limiting example, the cutting element can include a ceramic overcoated with CVD diamond.

In some embodiments, the cutting elements can be generally tooth-like, individual projections. In other aspects of the invention, the cutting elements can include cutting blades. As used herein, a "cutting blade" is to be understood to refer to a cutting element that includes a length (or width, the portion referenced being the portion that cuts the pad material) greater than a height (the portion that is "sunk" below an initial surface of the pad material). The cutting blades can advantageously be used to remove a larger percentage of pad material per pass. The cutting blades can also include varying cutting angles along the length of the cutting blades, and can include individual teeth formed thereon, or therewith. Serrations, protrusions, and the like can also be formed on or in the cutting blades, or attached thereto, to enhance the cutting ability of the teeth or blades.

The cutting elements of the present invention can be associated with the base 114 in a variety of manners. In one embodiment, the cutting elements and the base are formed from an integral piece of material, such as a polycrystalline diamond compact, a polycrystalline cubic boron nitride compact, and the like. In other aspects, the cutting elements can be bonded, welded or otherwise attached to the base.

Also, various reverse casting methods may be utilized to associate the cutting elements with the base. For example, a spacer layer may be applied to a working surface of a temporary substrate. The cutting elements can be arranged so that at least a portion of each the cutting elements is at least partially embedded in the spacer layer. In one aspect, the cutting elements can be pressed by a variety of mechanisms or means such that tips of the cutting elements come into contact with the temporary substrate. In this manner, the temporary substrate can define the final leveling configuration (e.g., contour) of the finished pad conditioner/cutting tool. As such, the temporary substrate can include varying degrees and combinations of contour, levelness, slope, steps, etc., according to the desired contours of the pad conditioner/cutting tool.

An adhesive may be optionally applied to the temporary substrate and/or the spacer layer and/or the cutting elements to facilitate proper arrangement and temporary attachment. The adhesive used on any noted surface may be any adhesive known to one skilled in the art, such as, without limitation, a polyvinyl alcohol (PVA), a polyvinyl butyral (PVB), a polyethylene glycol (PEG), a pariffin, a phenolic resin, a wax emulsion, an acrylic resin, or combinations thereof. In one aspect, the fixative is a sprayed acrylic glue.

The spacer layer may be made from any soft, deformable material with a relatively uniform thickness, and may be selected according to particular needs of manufacturing, future use, compositional considerations of tool precursors, etc. Examples of useful materials include, but are not limited to, rubbers, plastics, waxes, graphites, clays, tapes, grafoils, metals, powders, and combinations thereof. In one aspect, the spacer layer may be a rolled sheet comprising a metal or other powder and a binder. For example, the metal may be a stainless steel powder and a polyethylene glycol binder. Various binders can be utilized, which are well known to those skilled in the art, such as, but not limited to, a polyvinyl alcohol (PVA), a polyvinyl butyral (PVB), a polyethylene glycol (PEG), a paraffin, a phenolic resin, a wax emulsions, an acrylic resin, and combinations thereof.

An at least partially uncured resin material can be applied to the spacer layer opposite of the temporary substrate. A mold, e.g. of stainless steel or otherwise, may be utilized to contain the uncured resin material during manufacture. Upon curing the resin material, a resin layer is formed, cementing at least a portion of a cutting element. Optionally, a permanent tool substrate may be coupled to the resin layer to facilitate its use in dressing a CMP pad or in other uses. In one aspect, the permanent substrate may be coupled to the resin layer by means of an appropriate adhesive. The coupling may be facilitated by roughing the contact surfaces between the permanent substrate and the resin layer. In another aspect, the permanent substrate may be associated with the resin material, and thus become coupled to the resin layer as a result of curing. The mold and the temporary substrate can subsequently be removed from the CMP pad dresser once the resin is cured. Additionally, the spacer layer can be removed from the resin layer. This may be accomplished by any means known in the art including peeling, grinding, sandblasting, scraping, rubbing, abrasion, etc. Therefore, the protrusion of the cutting elements from the resin is dependent on the amount covered or concealed by the spacer layer. Additionally, the arrangement of the cutting elements can be relatively fixed by the resin. As such, the cutting elements can be placed in a variety of configurations, thus creating a variety of configurations of a surface of an assembled tool (e.g., pad conditioner).

Each of the cutting elements can include a substantially planar trailing face (e.g., 140*a*, 140*b* in FIG. 18 and 140*c* in FIG. 20) that can define a workpiece contact area. A combined workpiece contact area of all of the cutting elements can comprise from between about 5% of a total area of the base to about 20% of a total area of the base. Thus, in one aspect of the invention, if a pad dresser has a diameter of about 100 mm, and the combined contact areas of the cutting element will be about 10% of that total, then the total contact area of all cutting elements can be about 7850 $mm^2$. An edge-to-area ratio of each cutting element can be about 4/mm, resulting in a total edge length being about 31400 mm.

The cutting devices of the present invention can be utilized in either a wet system or a dry system. In a dry application, the cutting elements can be used to cut or plane chips from a workpiece without the presence of a liquid slurry. In a typical application, the cutting device can be mounted to a holder cushion that can be coupled to a rotatable chuck. The workpiece, for example, a silicon wafer or a CMP pad, can be coupled to a vacuum chuck that provides for rotation of the workpiece. Both the rotatable chuck and the vacuum chuck can be rotated in either a clockwise or a counterclockwise direction to remove material from the workpiece. By changing the rotation of one element relative to another, more or less material can be removed in a single rotation of the workpiece. For example, if the workpiece and cutting elements are rotated in the same direction (but at different speeds), less material will be removed than if they are rotated counter to one another.

In this typical application, a slurry can be applied that can aid in planing the workpiece surface. The slurry can be either a water slurry or a chemical slurry. In the case where a chemical slurry is used, the chemical can be selected to provide cooling or to react with the surface of the workpiece to soften the workpiece to provide a more efficient cutting process. It has been found that the wear rate of a silicon wafer can be dramatically increased by softening its surface. For example, a chemical slurry that contains an oxidizing agent (e.g. $H_2O_2$) may be used to form a relatively highly viscous oxide that will tend to "cling" on the wafer surface. In this case, the PCD cutting devices of the present invention need not necessarily cut the wafer, but rather can scrape the oxide off the surface of the wafer. Consequently, the sharpness of the cutting edge becomes less critical. In addition, the service life of the cutting device can be greatly extended by utilizing a slurry. For example, a PCD scraper used with a slurry may last 1000 times longer than a PCD cutter.

In addition to the structural aspects discussed above, the present invention also provides a method of conditioning a CMP pad is provided, including: engaging material of the CMP pad with a cutting tip of at least one cutting element; moving the cutting element and the CMP pad relative to one another to thereby remove material from the CMP pad with the cutting tip of the cutting element to create an exposed layer of CMP pad material; engaging the exposed layer of CMP pad material with the cutting tip of the cutting element, or with a cutting tip of a second cutting element; and moving the cutting element engaged with the exposed layer of CMP pad material and the CMP pad relative to one another to thereby remove the exposed layer of CMP pad material.

Engaging the exposed layer of CMP pad material can comprise engaging the exposed layer with the cutting tip of the cutting element used to create the exposed layer.

Engaging the exposed layer of CMP pad material can comprise engaging the exposed layer with the cutting tip of the second cutting element.

The present invention also provides a method of conditioning a CMP pad, including: removing, with a cutting element, a thin layer of material from the CMP pad; and removing, with the same or a different cutting element, a second layer of material from the CMP, the second layer of material being revealed by removal of the thin layer of material.

Abrasive tools formed according to the methods presented herein can be used as a final abrasive tool, e.g. utilized as a CMP dresser. Alternatively, the abrasive tools can be combined, or used as an element or elements in an abrasive tool assembly to form a CMP dresser.

Figure 24:
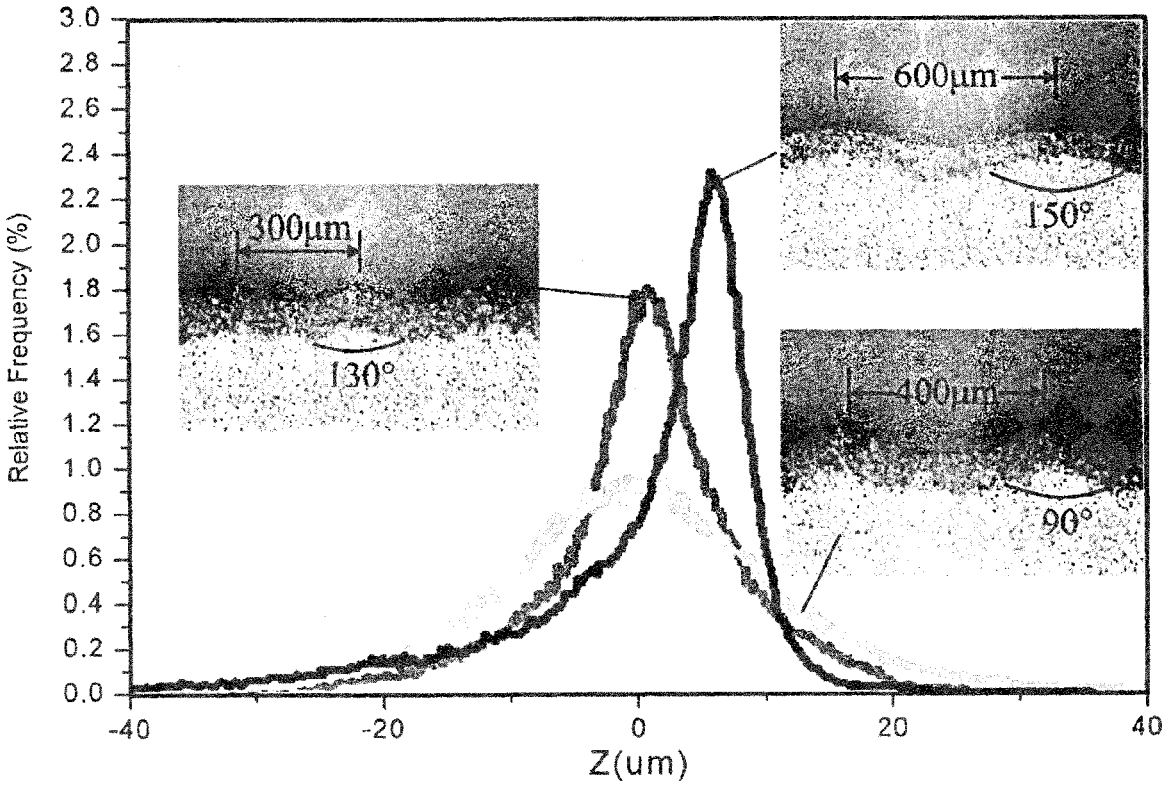
FIG. 24 illustrates the performance of various cutting teeth (varied in both shape and spacing) of the present invention.
Figure 25:
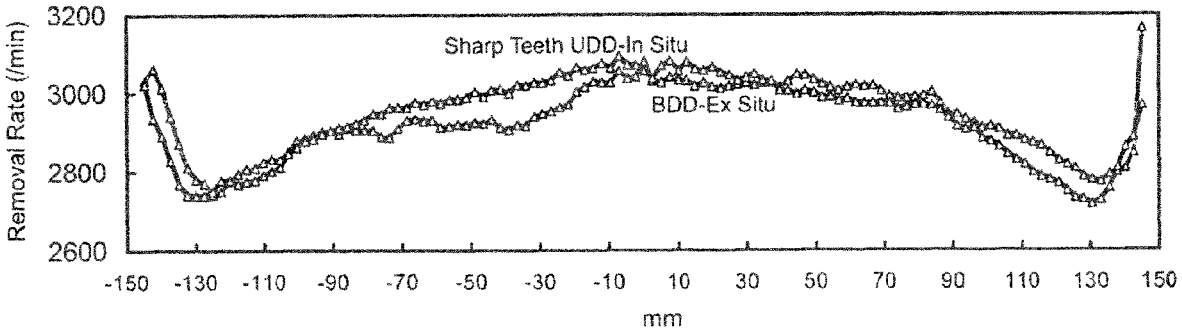
FIG. 25 illustrates a comparison of a pad dresser in accordance with the present invention as compared to conventional technology.

FIGS. 24 and 25 illustrate data associated with another aspect of the invention, in which a sharpness and spacing of cutting "teeth" of various cutting elements or precursors are varied to address issues relating to asperities formed in the pad during dressing. As will be appreciated from FIG. 24, the more "rolling" cutting teeth illustrated with an angle of about 150 degrees have been shown to provide a better abrading profile than do the slightly wavy cutting teeth at about 130 degrees, and the more sharp cutting teeth formed at about 90 degrees. The more rolling cutting teeth are advantageous in that tips of the cutting teeth are not prone to breakage during use, and during manufacture or formation of the cutting teeth. This advantage increases the precision with which the cutting teeth can dress pads, and increases the life of the cutting teeth, and greatly decreases the cost for which the dressers can be manufactured.

The data presented in FIG. 25 illustrates the wafer profile for a WCMP with in-situ dressing of the present pad conditioner as compared to a conventional brazed diamond dressing pad. Due to the simultaneous dressing and polishing provided by the present invention, the throughput could be increased by as much as 25%.

It is to be understood that the above-described arrangements are only illustrative of the application of the principles of the present invention. Numerous modifications and alternative arrangements may be devised by those skilled in the art without departing from the spirit and scope of the present invention and any appended or following claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An abrasive tool, comprising:

an assembly of tool precursors including at least one elongated substrate having a continuous cutting element of polycrystalline diamond, polycrystalline cubic boron nitride, or ceramic formed into a blade shape on a surface thereof; and a setting material configured to attach the tool precursors into a single mass that forms a predetermined cutting configuration, wherein the blade shaped tool precursors are arranged in a pattern, wherein the surfaces having the cutting element are oriented into substantially a single plane and wherein the pattern is an alternating pattern with at least one blank elongated substrates or elongated substrates having a continuous cutting element formed into a non-blade shape on a surface thereof.

2. The abrasive tool of claim 1, further comprising at least one elongated substrate having a continuous cutting element formed into a plurality of asperities.

3. The abrasive tool of claim 2, wherein the plurality of asperities include pyramidal shapes.

4. The abrasive tool of claim 2, wherein the abrasive tool includes at two abrasive precursors having elongated substrates that, when placed together, form asperities having substantially pyramidal shapes.

5. The abrasive tool of claim 1, wherein the abrasive precursors having a continuous cutting element on a surface thereof are arranged such that the protruding portions of the cutting element are substantially level.

6. The abrasive tool of claim 1, wherein the cutting element is polycrystalline diamond.

7. The abrasive tool of claim 1, wherein at least one abrasive tool is used as an element in an abrasive tool assembly.

8. The abrasive tool of claim 1, wherein the assembly includes a plurality of elongated tool precursors in a substantially parallel formation.

9. The abrasive tool of claim 1, wherein a plurality of tool precursors include surfaces having an inverse profile of another tool precursor.

* * * * *